US007413497B2

(12) United States Patent
Caldwell et al.

(10) Patent No.: US 7,413,497 B2
(45) Date of Patent: Aug. 19, 2008

(54) CHEMICAL MECHANICAL POLISHING SLURRY PUMP MONITORING SYSTEM AND METHOD

(75) Inventors: Daniel R. Caldwell, The Colony, TX (US); Thomas Kiez, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 945 days.

(21) Appl. No.: 10/706,762

(22) Filed: Nov. 10, 2003

(65) Prior Publication Data

US 2005/0101223 A1 May 12, 2005

(51) Int. Cl.
*B24B 49/00* (2006.01)

(52) U.S. Cl. ..... 451/5; 451/8; 451/60; 451/446

(58) Field of Classification Search ..... 451/5, 451/6, 8, 60, 446
See application file for complete search history.

(56) References Cited

U.S. PATENT DOCUMENTS 6,183,341 B1 * 2/2001 Melcer ..... 451/5
6,413,154 B1 * 7/2002 Togawa et al. ..... 451/285
6,676,383 B2 * 1/2004 Schob ..... 417/53

* cited by examiner

*Primary Examiner*—Dung Van Nguyen
(74) *Attorney, Agent, or Firm*—Wade James Brady, III; Frederick J. Telecky, Jr.

(57) ABSTRACT

According to one embodiment of the invention, a chemical mechanical polishing monitoring system includes a pump delivering a slurry to a polishing pad and a rotation sensing device coupled to the pump. The rotation sensing device senses a rotation of the pump and generates a signal indicative of the rotation of the pump.

2 Claims, 2 Drawing Sheets

CHEMICAL MECHANICAL POLISHING SLURRY PUMP MONITORING SYSTEM AND METHOD

TECHNICAL FIELD OF THE INVENTION

The present invention relates generally to semiconductor wafer processing and, more particularly, to a chemical mechanical polishing ("CMP") slurry pump monitoring system and method.

BACKGROUND OF THE INVENTION

Chemical mechanical polishing ("CMP") is a semiconductor wafer planarizing and/or polishing procedure widely used in the fabrication of semiconductor wafers. As the name implies, there are two components to the process: chemical and mechanical polishing. Chemical polishing involves the introduction of chemicals that dissolve imperfections and impurities present upon the wafer. Mechanical polishing involves rotating the wafer upon an abrasive pad in order to planarize the wafer.

Generally, the wafers are mounted upside down on a wafer carrier and rotated above a polishing pad sitting on a platen, which is also rotated. Typically, a slurry containing both chemicals and abrasives is introduced upon the pad via a slurry delivery system that includes a slurry pump. If for some reason the slurry pump malfunctions then slurry may not be adequately delivered to the polishing pad, which may cause problems with the wafers that are being polished, such as severe scratching, inadequate polishing, or incorrect wafer thickness after the CMP process.

SUMMARY OF THE INVENTION

According to one embodiment of the invention, a chemical mechanical polishing monitoring system includes a pump delivering a slurry to a polishing pad and a rotation sensing device coupled to the pump. The rotation sensing device senses a rotation of the pump and generates a signal indicative of the rotation of the pump.

Embodiments of the invention provide a number of technical advantages. Embodiments of the invention may include all, some, or none of these advantages. Reducing defects and eliminating problems associated with semiconductor wafers during a chemical mechanical polishing ("CMP") process greatly improves yield. A slurry pump real-time monitoring system facilitates the quick detection of pump malfunction, which may lead to quick CMP tool interdiction. In one embodiment, a tachogenerator or similar rotation sensing device allows the monitoring of slurry pump rotation in real-time. The tachogenerator sends a signal to a computer that is indicative of the actual rotation of the pump, which may then be compared to a desired rotation of the pump in order to detect slurry pump malfunction so that remedial measures may be taken. The retrofit of existing CMP systems is relatively easy and may be done at low-cost.

Other technical advantages are readily apparent to one skilled in the art from the following figures, descriptions, and claims.

BRIEF DESCRIPTION OF THE DRAWINGS

For a more complete understanding of the present invention and its advantages, reference is now made to the following descriptions, taken in conjunction with the accompanying drawings, in which.

DETAILED DESCRIPTION OF EXAMPLE EMBODIMENTS OF THE INVENTION

Example embodiments of the present invention and their advantages are best understood by referring now to FIGS. 1 through 4 of the drawings, in which like numerals refer to like parts.

Figure 1:
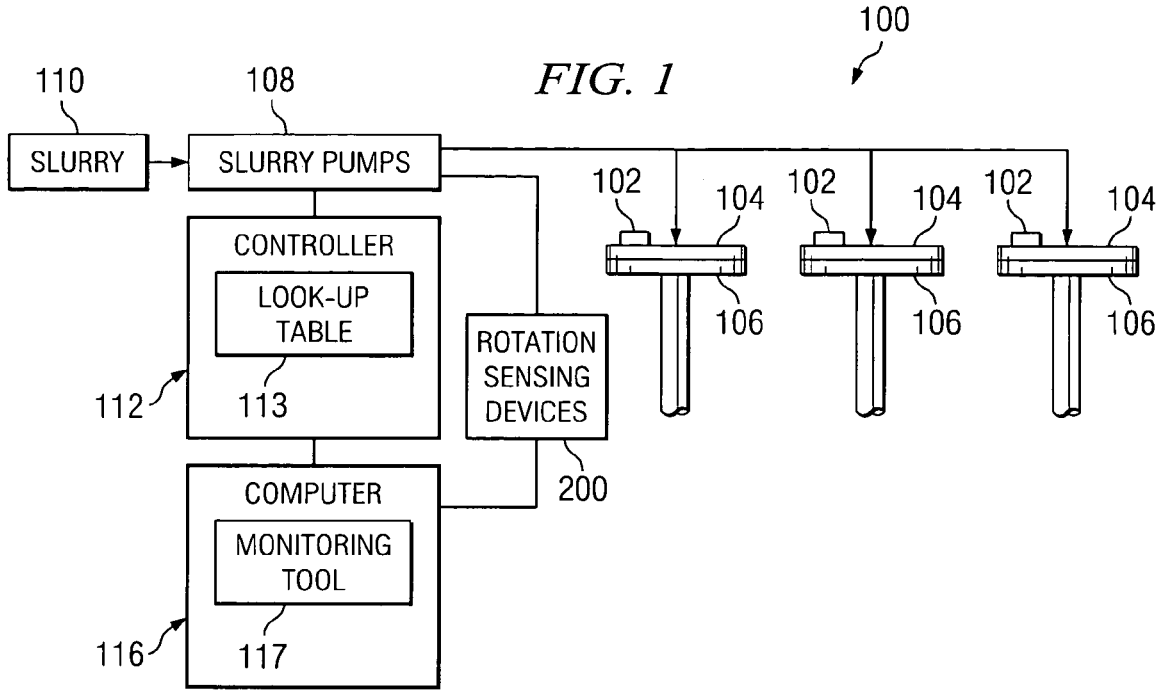
FIG. 1 is a perspective view of a chemical mechanical polishing ("CMP") system in accordance with one embodiment of the present invention.

FIG. 1 is a partial block diagram of a simplified chemical mechanical polishing ("CMP") system 100 in accordance with one embodiment of the present invention. Generally, CMP system 100 functions to polish and/or planarize one or more semiconductor wafers 102 during the processing of semiconductor wafers 102. Any suitable CMP system may be utilized within the teachings of the present invention, which contemplates more, less, or different components than those shown in FIG. 1. The type of CMP system, along with the size, shape, and configuration of various components illustrated may be varied significantly within the teachings of the present invention. In the illustrated embodiment, CMP system 100 includes a plurality of polishing pads 104 coupled to respective platens 106, a plurality of slurry pumps 108 for delivering a liquid slurry 110 to the top surfaces of polishing pads 104, a controller 112 having a look-up table 113, a plurality of rotation sensing devices 200, and a computer 116 having a monitoring tool 117.

Platens 106, which may be formed from any suitable material such as aluminum or stainless steel, and polishing pads 104 are configured to rotate during a CMP process. In addition, a wafer carrier or other suitable device (not illustrated) facilitates the rotation of wafers 102, typically in a direction opposite that of platens 106 and polishing pads 104. Accordingly, when wafers 102 engage polishing pads 104 while both are rotating, wafers 102 are polished and/or planarized to provide a clean, flat surface on wafers 102.

Slurry pumps 108 function to delivery slurry 110 to polishing pads 104 to enhance the CMP process. Any suitable number of slurry pumps 108 may be associated with a particular polishing pad 104 in order to deliver one or more slurries 110 to that particular polishing pad 104. Any suitable types of pumps may be utilized for slurry pumps 108 to delivery slurry 110 to respective polishing pads 104; however, in one embodiment of the invention, peristaltic pumps are utilized to deliver slurry 110 to polishing pads 104. Three such peristaltic pumps are illustrated below in conjunction with FIG. 2A.

Slurry 110 may include waters, acids, and/or other suitable chemicals that interact with wafers 102 in order to loosen, or at least partially remove, metals, oxidation, and other impurities present upon wafers 102. Slurry 110 may also include small particles of glass and/or other suitable abrasive materials that grind wafer 102 during a CMP process. Slurry 110 may be stored in any suitable manner and it may be pumped through any suitable conduit system by slurry pumps 108 in order to be delivered to polishing pads 104 of CMP system 100.

Controller 112 represents any suitable logic encoded in media that functions to control one or more functions of CMP system 100. For example, controller 112 may use look-up table 113 stored in any suitable storage location to send a suitable signal, such as a drive voltage, to slurry pumps 108 so that slurry pumps 108 operate at an adequate rotational speed corresponding to a desired flow rate for slurry 110.

According to the teachings of one embodiment of the invention, rotation sensing devices 200 are coupled to respective slurry pumps 108 in order to sense a rotation of each slurry pump 108. Generally, each rotation sensing device 200 coupled to its respective slurry pump 108 generates a signal indicative of the rotation of slurry pump 108 for the purpose of monitoring slurry pump 108 during use. This feedback from rotation sensing device 200 allows CMP personnel to monitor slurry pump 108 in real-time in order to detect any problems associated with slurry pump 108 so that remedial measures may be quickly taken in order to prevent scrapping of wafers 102. Another advantage of utilizing rotation sensing devices 200 is that rotation sensing devices 200 may be retrofit to existing CMP systems in a relatively easy and low cost manner.

During the polishing of a particular wafer 102, slurry pump 108 is utilized to deliver slurry 110 to that particular wafer 102. Rotation sensing device 200, which is coupled to slurry pump 108, senses a rotation of slurry pump 108 and, based on the signal it generates, which is indicative of the rotation of slurry pump 108, CMP personnel are able to detect intermittent or total failure of slurry pump 108. This malfunctioning of slurry pump 108 indicates that an improper amount of slurry 110 is being delivered to wafer 102, which could cause major defects or problems with wafer 102 during the polishing process. This is a considerable waste of time and money. Rotation sensing devices 200, which are described in more detail below in conjunction with FIGS. 2A and 2B, may send the generated signals to computer 116 in order to facilitate the real time monitoring of slurry pumps 108 with the aid of monitoring tool 117.

Computer 116 is any suitable computing device that is coupled to rotation sensing device 200 and controller 112 for the purpose of monitoring one or more functions of CMP system 100. For example, computer 116 may have monitoring tool 117 in order to provide certain data or information to CMP system 100 personnel in order to ensure the smooth operation of CMP system 100. In addition, monitoring tool 117, which may be any suitable computer program or set of computer programs stored in any suitable storage location, may also function to quickly alert CMP personnel to any problems associated with CMP system 100 so that remedial measures may be taken quickly and efficiently. Monitoring tool 117 may also have other suitable functions.

Figure 2A:
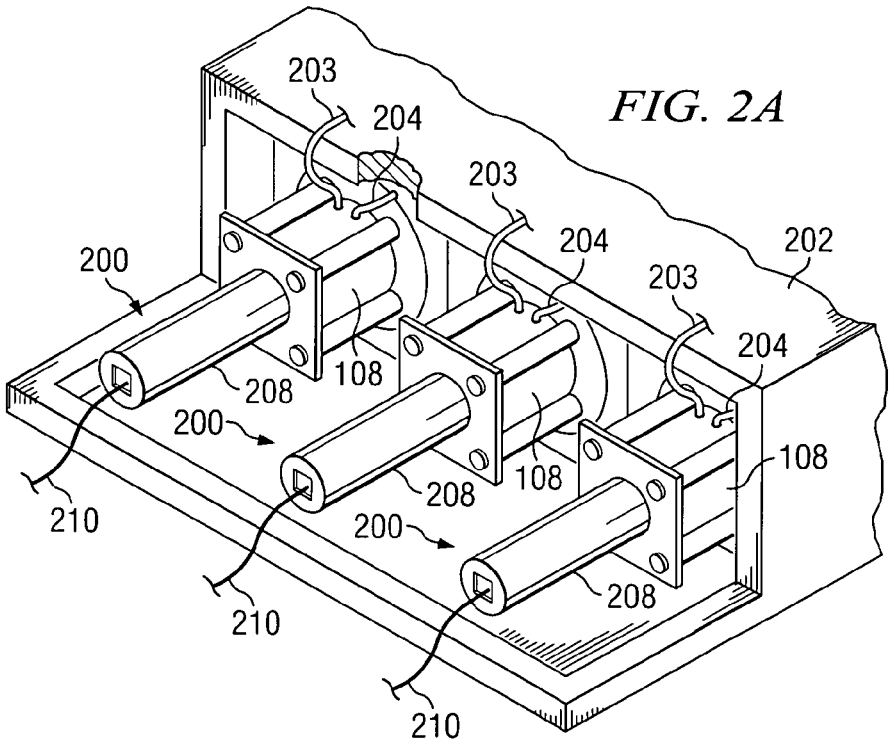
FIG. 2A is a top perspective view a plurality of slurry pumps in accordance with one embodiment of the present invention.

FIG. 2A is a top perspective view of slurry pumps 108 in accordance with one embodiment of the invention. Although only three pumps are illustrated in FIG. 2A, the present invention contemplates any suitable number of slurry pumps 108 to be utilized with CMP system 100. As illustrated in FIG. 2A, slurry pumps 108 are in the form of peristaltic pumps that are housed within a pump shelf 202, which may be any suitable housing for slurry pumps 108. Slurry pumps 108 each include an input conduit 203 that receives slurry 110 from its storage location at a first pressure and output conduit 204 that delivers slurry 110 to respective polishing pads 104 at a somewhat lower pressure after transferring through slurry pump 108.

Figure 2B:
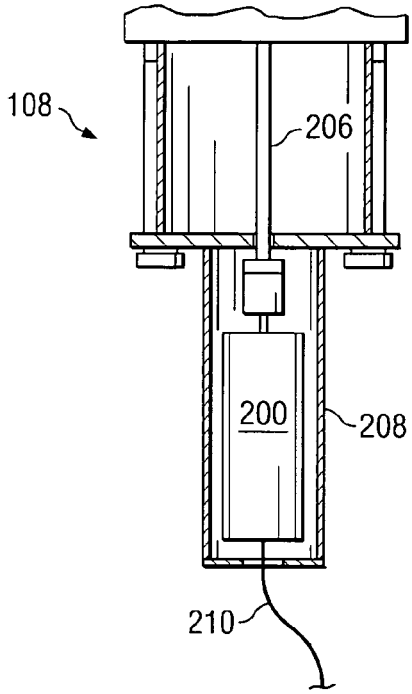
FIG. 2B is an elevation view of a slurry pump having a rotation sensing device coupled thereto in accordance with one embodiment of the present invention.

Also illustrated in FIG. 2A, and with reference to FIG. 2B, are rotation sensing devices 200 coupled to an end of each slurry pump 108. In the illustrated embodiment, rotation sensing devices 200 are tachogenerators, which sense a rotation of a rotating shaft and generate a signal indicative of the rotational speed of the rotating shaft. One example of a tachogenerator is a Dynamo Tachymetrique, type no. RE 012 1CB0 02CA, manufactured by Radio-Energie of France. However, rotation sensing devices 200 may be any suitable devices that sense a rotation of slurry pumps 108, such as encoders, fiber optic detectors, digital counters, or other suitable rotation sensing devices. Rotation sensing devices 200 may be coupled to a rotating shaft 206 at either end of slurry pumps 108 or may be coupled to slurry pumps 108 in any manner suitable for sensing the rotational speed of slurry pumps 108.

Each rotation sensing device 200 may be housed within a suitable housing 208 in order to protect rotation sensing device 200 from its environment. In addition, in order to send the signal generated by rotation sensing device 200, each rotation sensing device 200 includes a suitable communications link 210, such as a copper wire, in order to send the signal to computer 116 or other suitable location. In the illustrated embodiment, rotation sensing device 200 is a tachogenerator and, as such, converts the mechanical rotation of slurry pump 108 into a voltage signal that may then be transmitted over link 210 to computer 116 in order to monitor slurry pump 108 during use. Again, other suitable rotation sensing devices using any suitable communications link may be utilized within the teachings of the present invention. The signal transmitted by rotation sensing device 200 may also take other suitable forms other than a voltage. An embodiment of the invention in which a tachogenerator is utilized for rotation sensing device 200 generating a voltage signal is illustrated in FIG. 3.

Figure 3:
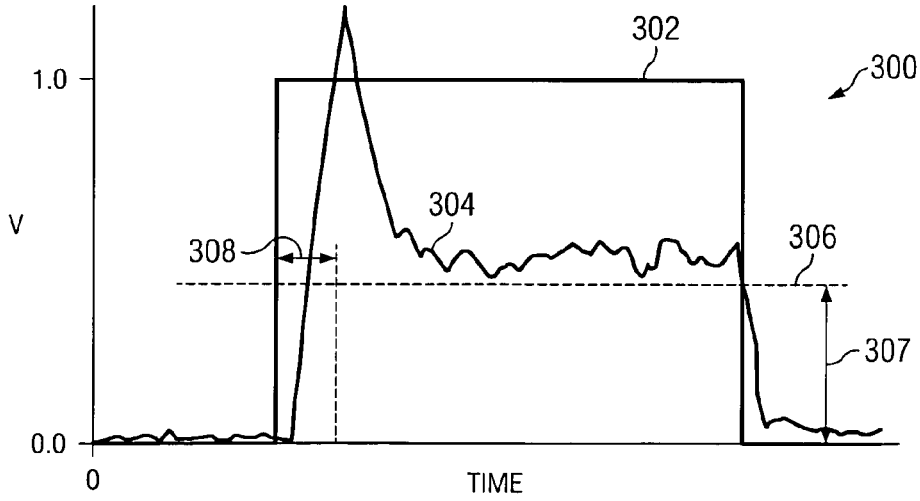
FIG. 3 is a graph illustrating voltage versus time during a CMP process in accordance with one embodiment of the present invention.

Referring to FIG. 3, a graph 300 illustrating voltage versus time during a particular CMP process is illustrated in accordance with one embodiment of the invention. Graph 300 may be generated by monitoring tool 117. Graph 300 includes a drive signal 302 that corresponds to the drive voltage transmitted from controller 112 to a particular slurry pump 108, and a voltage signal 304 that is received from rotation sensing device 200 coupled to slurry pump 108 that is indicative of the rotation of slurry pump 108. A threshold signal indicated by reference numeral 306 represents a threshold voltage that is compared to received voltage signal 304 in order to monitor slurry pump 108 during use. Threshold voltage 306 may be any suitable voltage threshold. Graph 300 also illustrates a response time 308 in which rotation sensing device 200 must generate an adequate signal at the beginning of a CMP cycle; otherwise, there is an indication of a potential failure of slurry pump 108 to a user of CMP system 100. In a particular embodiment of the invention, response time 308 is approximately five seconds; however, other suitable response times may be utilized.

Although any suitable criteria may be used to indicate a potential problem with slurry pump 108, in one embodiment, if voltage signal 304 drops below threshold signal 306 for a predetermined period of time, than an indication of intermittent or total failure of slurry pump 108 exists. Monitoring tool 117 may have suitable logic contained therein that automatically generates a message based on the comparison of voltage signal 304 to threshold signal 306. For example, an e-mail, a page, or other suitable message may be sent to a user of CMP system 100 in order to indicate a potential problem with slurry pump 108.

Figure 4:
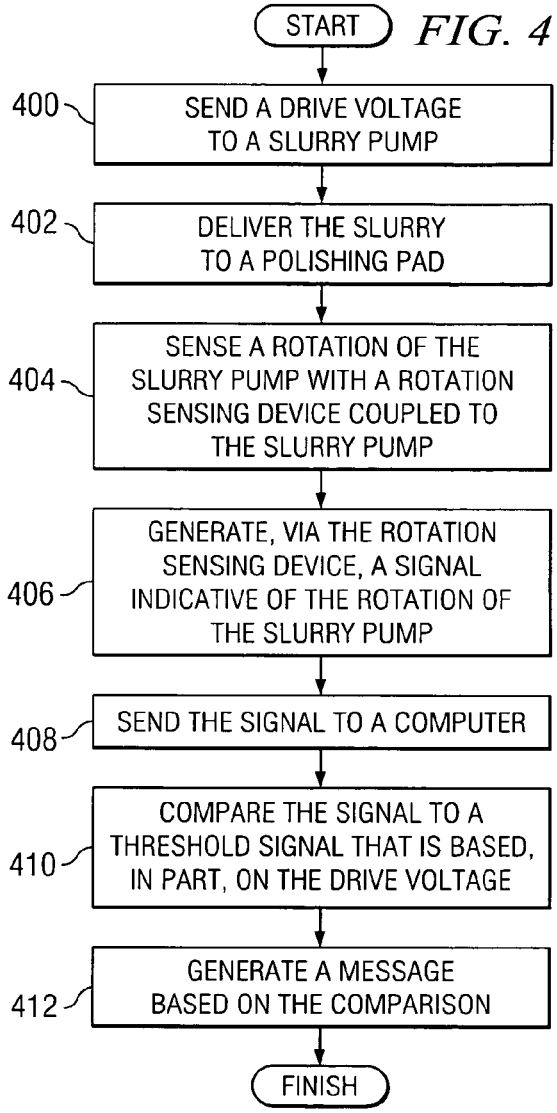
FIG. 4 is a flowchart illustrating a CMP slurry pump monitoring method in accordance with one embodiment of the present invention.

FIG. 4 is a flowchart illustrating an example CMP slurry pump monitoring method in accordance with one embodiment of the invention. The method begins at step 400 where a drive voltage, as indicated by drive signal 302 in FIG. 3, is sent to slurry pump 108. The drive voltage is based on the desired volumetric flow rate for slurry 110 and may be obtained from look-up table 113 in controller 112 (FIG. 1). Accordingly, slurry 110 is delivered to polishing pad 104 at step 402. A rotation of slurry pump 108 is sensed at step 404 with rotation sensing device 200 coupled to slurry pump 108. A signal, such as a voltage signal, indicative of the rotation of slurry pump 108 is generated by rotation sensing device 200, as indicated at step 406. The signal may then be sent to computer 116, as indicated by step 408.

As indicated by step 410, the signal is received at computer 116 and compared using monitoring tool 117 to threshold signal 306 that is based, at least in part, on the drive voltage sent to slurry pump 108. This comparison step is illustrated graphically by graph 300 in FIG. 3. If graph 300 indicates a potential problem with slurry pump 108, then a message may be generated by monitoring tool 117 and sent to appropriate personnel, as indicated by step 412. This then ends the example method outlined in FIG. 4.

Thus, reducing defects and eliminating problems associated with wafers 102 during a CMP process greatly improves yield by a real-time slurry pump monitoring system facilitated by coupling rotation sensing devices to respective slurry pumps. Quick detection of potential pump malfunction leads to quick remedial measures that improves yield for wafers 102.

Although embodiments of the invention and their advantages are described in detail, a person skilled in the art could make various alterations, additions, and omissions without departing from the spirit and scope of the present invention as defined by the appended claims.

What is claimed is:

1. A chemical mechanical polishing monitoring system, comprising:

a peristaltic pump operable to deliver a slurry to a polishing pad;

a controller operable to send a drive voltage to the peristaltic pump based on a desired volumetric flow rate for the slurry;

a rotation sensing device coupled to a rotating shaft of the peristaltic pump and operable to sense a rotation of the peristaltic pump, the rotation sensing device further operable to generate a voltage indicative of the rotation of the peristaltic pump, and a computer coupled to the rotation sensing device and the controller, the computer operable to:

receive the drive voltage from the controller;

receive the voltage from the rotation sensing device; and compare the voltage to a threshold voltage that is based, in part, on the drive voltage in order to monitor the peristaltic pump during use;

wherein the computer is further operable to generate a message based on the comparison.

2. A chemical mechanical polishing monitoring method, comprising:

sending a drive voltage to a pump, the drive voltage based on a desired volumetric flow rate for a slurry;

delivering, via the pump, the slurry to a polishing pad;

sensing a rotation of the pump;

generating a signal indicative of the rotation of the pump;

comparing the signal to a threshold signal that is based, in part, on the drive voltage in order to monitor the pump during use; and generating a message based on the comparison.

* * * * *